US007156357B1

(12) United States Patent
Kocur

(10) Patent No.: US 7,156,357 B1
(45) Date of Patent: Jan. 2, 2007

(54) PATIO UMBRELLA SUPPORT APPARATUS

(76) Inventor: William M. Kocur, 841 Vaughn Rd., Pottstown, PA (US) 19465

( * ) Notice: Subject to any disclaimer, the term of this patent is extended or adjusted under 35 U.S.C. 154(b) by 120 days.

(21) Appl. No.: 10/873,786

(22) Filed: Jun. 22, 2004

Related U.S. Application Data

(60) Provisional application No. 60/488,114, filed on Jul. 17, 2003.

(51) Int. Cl.
*F16M 13/00* (2006.01)

(52) U.S. Cl. ..... 248/519; 248/231.9; 248/523

(58) Field of Classification Search ..... 248/519, 248/523, 530, 534, 539, 231.9; 52/127.3, 52/509; 43/21.2; 256/65.14; 403/388, 237
See application file for complete search history.

(56) References Cited

U.S. PATENT DOCUMENTS 278,973 A * 6/1883 Kizer ..... 248/514
4,582,287 A * 4/1986 DeLeary ..... 248/519
4,830,203 A * 5/1989 Ennis ..... 211/105.2
5,224,307 A * 7/1993 Lukos ..... 52/86
5,685,107 A * 11/1997 Sweet ..... 43/21.2
5,685,517 A 11/1997 Salibra ..... 248/519
6,003,826 A 12/1999 Galloway ..... 248/519
6,672,029 B1 * 1/2004 Tucker ..... 52/745.21
6,810,633 B1 * 11/2004 Harris, Sr. ..... 52/489.2

* cited by examiner

*Primary Examiner*—Korie Chan
(74) *Attorney, Agent, or Firm*—Miller Law Group, PLLC

(57) ABSTRACT

A patio umbrella support apparatus can be engaged by the mast of a patio umbrella to permit the positioning of the patio umbrella at desired, selected positions on a patio deck built with deck planks spaced apart by a conventional gap. The umbrella support apparatus is formed with an upright support member affixed to a pair of opposing horizontal support flanges that ride on top of the deck surface. A generally vertical anchoring fin is affixed to the support flanges and upright support member to fit within the conventional gap between deck planks. The anchoring fin and the horizontal flanges provide positional stability for the patio umbrella and permit flexibility in the location of the umbrella on the deck. A notch formed in the anchoring fin can receive a deck support cross beam and further limit movement of the umbrella support apparatus relative to the deck.

16 Claims, 5 Drawing Sheets

PATIO UMBRELLA SUPPORT APPARATUS

CROSS-REFERENCE TO RELATED APPLICATIONS

This application claims domestic priority on U.S. Provisional Patent Application Ser. No. 60/488,114, filed on Jul. 17, 2003, the contents of which are incorporated herein by reference.

BACKGROUND OF THE INVENTION

The present invention relates generally to a device for holding an umbrella, such as a patio umbrella, on a deck formed from planking, and, more particularly, to a support apparatus that receives a patio umbrella mast for selective positioning the umbrella on a patio deck.

Patio furniture, such as a patio table, can be formed with an opening extending vertically therethrough for the passage of a patio umbrella. In some patio tables, the frame for the support of the patio table includes an integral holder for the base of the patio umbrella. In other configurations, such as is depicted in U.S. Pat. No. 5,685,517, issued to Joseph Salibra on Nov. 11, 1997, the stand for mounting the base of the patio umbrella is bolted or clamped to the decking forming the floor of the patio deck. Thus, movement of the patio table from one location to another requires the unclamping or disconnection of the stand from the patio decking which, in turn, requires access to the clamping member beneath the decking.

In U.S. Pat. No. 6,003,826, issued to William Galloway, III, on Dec. 21, 1999, the patio umbrella is supported in a stand or holder that is movably supported on the patio deck, but is restrained from lateral movement by an upper bracket that is affixed to the deck railing, thus providing an upper and lower, vertically spaced, supports for the restraint of the patio umbrella or other elongated patio accessory, such as a plant hanger. While movement of the Galloway umbrella stand does not require access to a clamping apparatus beneath the patio decking, location of the support devices is limited to proximity to an elevated support member, such as a deck railing or the like. Furthermore, the Galloway support apparatus is hampered by the lack of restraint to the movement of the bottom stand member that receives the base of the patio umbrella. If this bottom stand member were bumped, the base of the umbrella would be subject to displacement relative to the upper support member.

Providing improvements in patio accessories in which the base of a patio umbrella can be supported to provide an easily detachable, yet positionally stable support stand for the patio umbrella would be desirable.

SUMMARY OF THE INVENTION

It is an object of this invention to overcome the disadvantages of the prior art by providing a patio umbrella stand that can positionally support a patio umbrella at selected locations on a patio deck formed with planks.

It is another object of this invention to provide stable support for a patio umbrella substantially irrespective of where the patio umbrella is to be placed on the patio deck.

It is a feature of this invention to provide an apparatus that can be moved from one location to another on a patio deck to support an umbrella mast.

It is an advantage of this invention that the umbrella stand can be moved to permit the movement of a patio table having an umbrella to a desired selected position on the deck.

It is another feature of this invention that the umbrella support apparatus is formed with an anchoring fin that is positionable between deck planks.

It is still another feature of this invention that the umbrella support apparatus is formed with a flange oriented generally perpendicularly to the anchoring fin to provide support for a patio umbrella on top of the deck planks.

It is yet another feature of this invention that the umbrella support apparatus is also formed with an upright support member that will engage and support an umbrella mast.

It is another advantage of this invention that the upright support member can be formed from tubular stock and sized to permit the reception therein of either a solid umbrella mast or a tubular umbrella mast.

It is still another feature of this invention that the upright support member can be formed with adjustable attachment devices that engage the umbrella mast inserted within the support member and stabilize the mast within the support member.

It is still another object of this invention to provide an umbrella stand apparatus that is flexible in use for utilization with umbrellas equipped with either solid or hollow umbrella masts.

It is another advantage of this invention that the upright support member can be formed and sized alternatively to fit internally of a hollow umbrella mast member.

It is still another advantage of this invention that the anchoring fin be sized to fit within a gap between deck planks so that the umbrella support apparatus be capable of being located substantially anywhere on the deck.

It is yet another feature of this invention that the anchoring fin can be formed with a notch that is sized to fit over a deck support beam.

It is yet another advantage of this invention that a positioning of the notch over a deck support beam positionally fixes the umbrella support apparatus on the deck.

It is a further advantage of this invention that the upper flange provides positional stability for the umbrella support apparatus on the top surface of the deck, while the anchoring fin limits movement of the apparatus across the surface of the deck, as limited by deck support beams below the deck planking.

It is yet another object of this invention to provide a patio umbrella support apparatus, which is durable in construction, inexpensive of manufacture, carefree of maintenance, facile in assemblage, and simple and effective in use.

These and other objects, features and advantages are accomplished according to the instant invention by providing a patio umbrella support apparatus that is operable to be engaged by the mast of a patio umbrella to permit the positioning of the patio umbrella at desired, selected positions on a patio deck built with deck planks spaced apart by a conventional gap. The umbrella support apparatus is formed with an upright support member affixed to a pair of opposing horizontal support flanges that ride on top of the deck surface. A generally vertical anchoring fin is affixed to the support flanges and upright support member to fit within the conventional gap between deck planks. The anchoring fin and the horizontal flanges provide positional stability for the patio umbrella and permit flexibility in the location of the umbrella on the deck. A notch formed in the anchoring fin can receive a deck support cross beam and further limit movement of the umbrella support apparatus relative to the deck.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION OF THE PREFERRED EMBODIMENT

Figure 1:
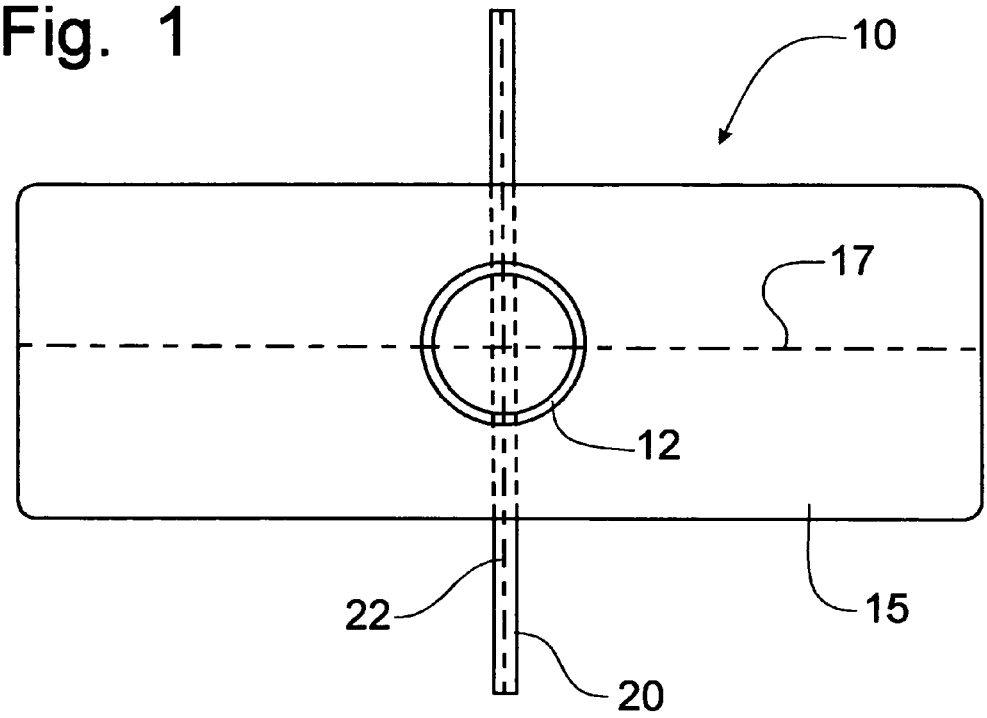
FIG. 1 is a top plan view of a patio umbrella stand incorporating the principles of the instant invention.
Figure 4:
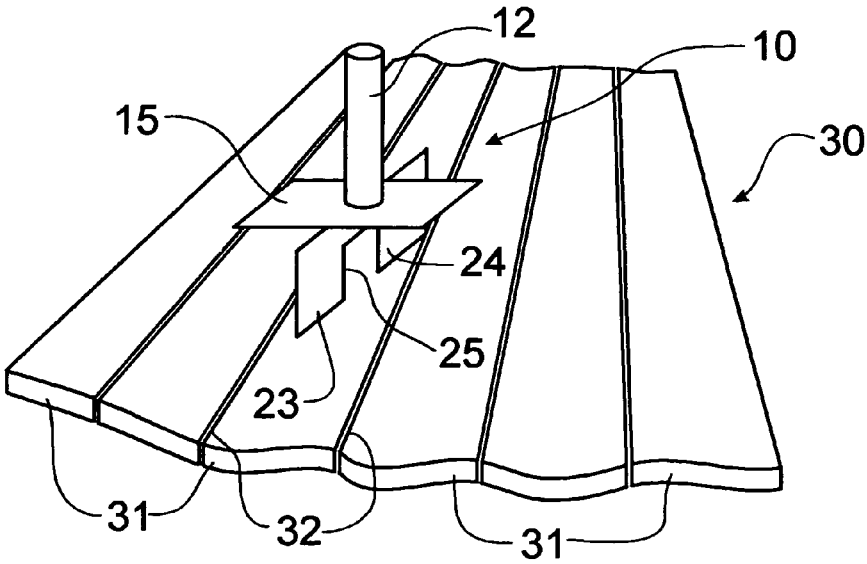
FIG. 4 is a perspective view of the patio umbrella stand with the anchoring fin positioned for insertion into a gap between adjacent deck planks.
Figure 2:
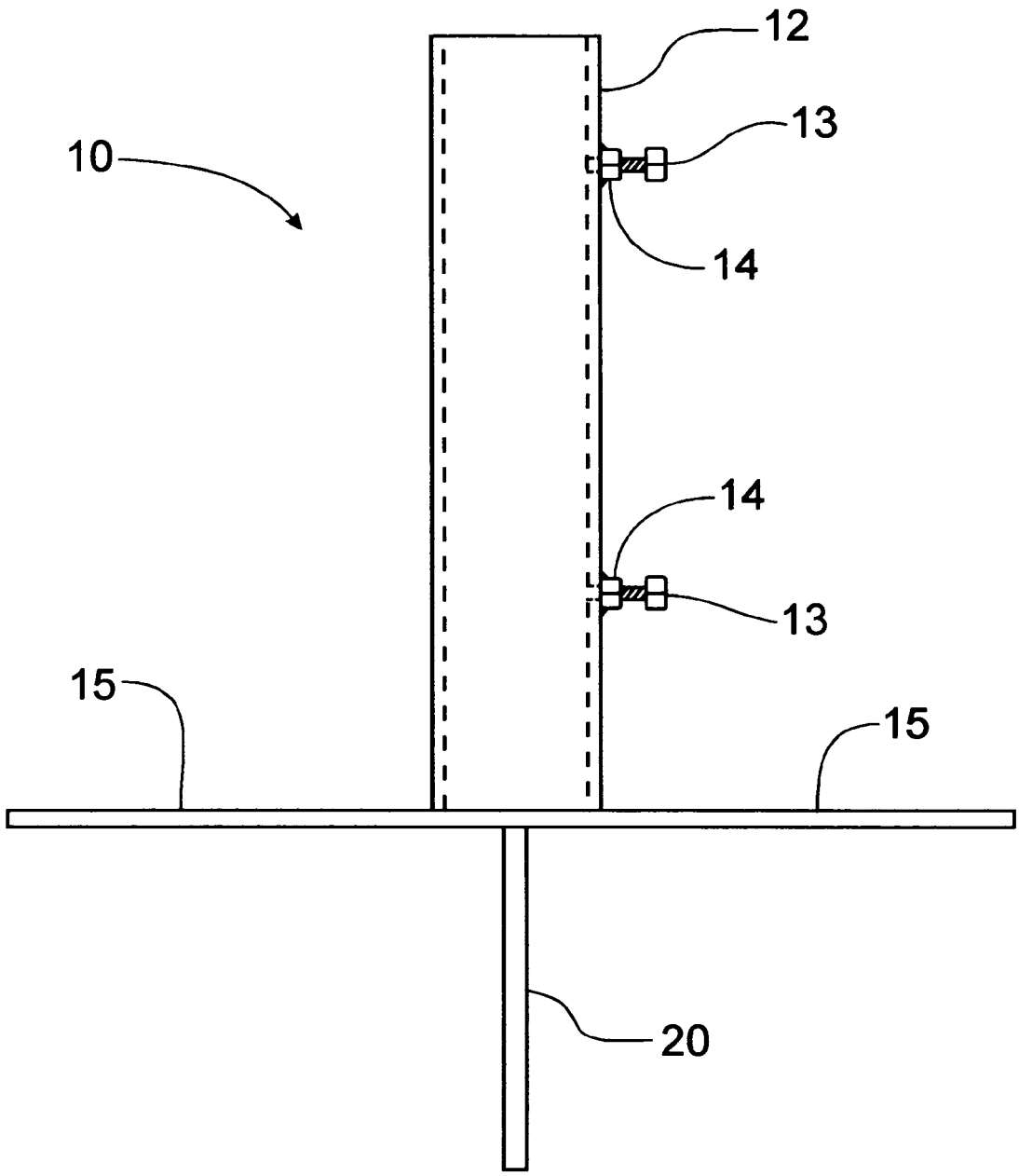
FIG. 2 is an elevational view of the patio umbrella stand shown in FIG. 1 viewed along the axis of the anchoring fins for positioning between deck flooring boards.
Figure 3:
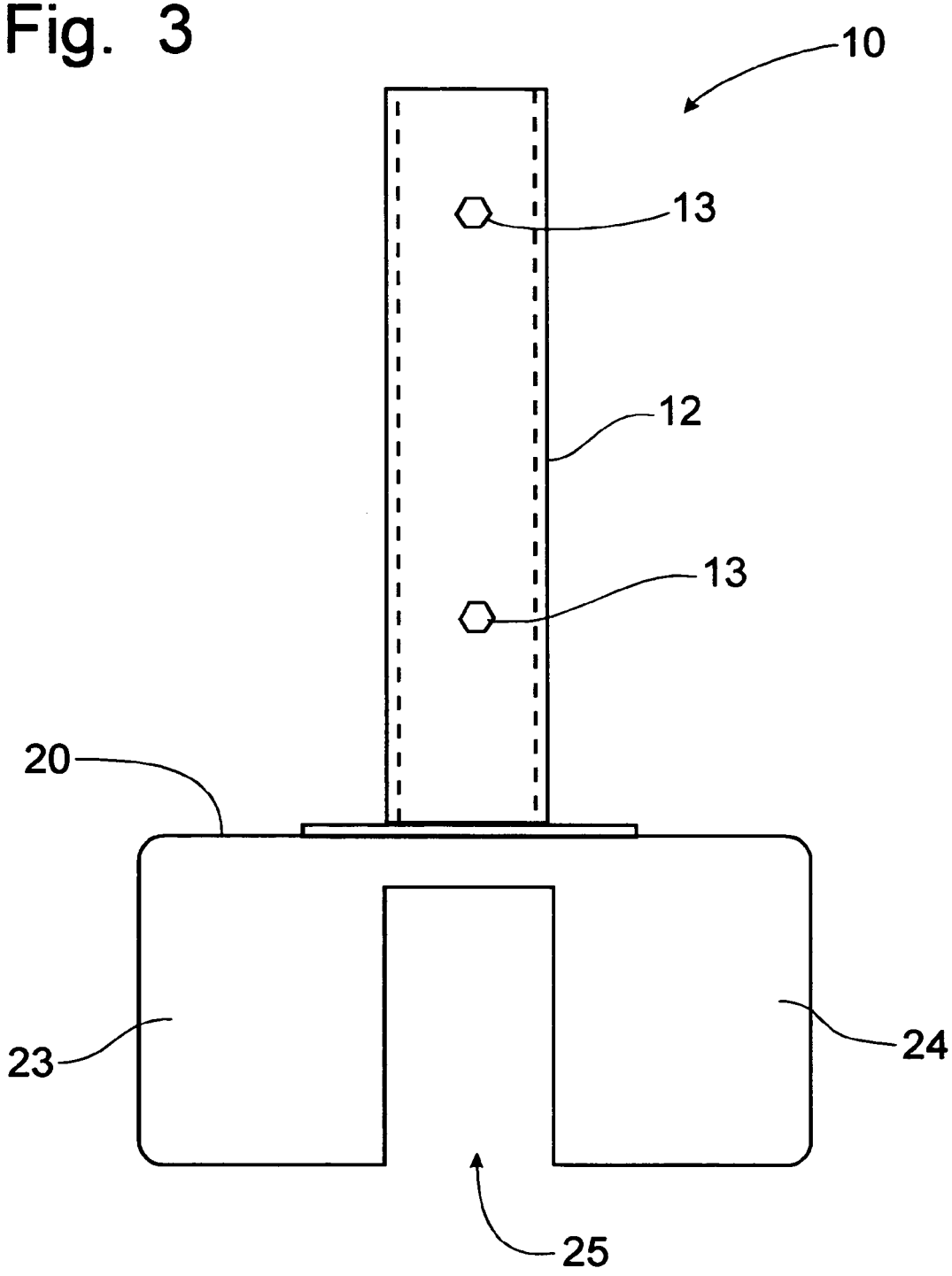
FIG. 3 is an elevational view of the patio umbrella stand viewed perpendicularly with respect to the view depicted in FIG. 2 with the anchoring fins being shown in elevation.

Referring now to FIGS. 1–7, a patio umbrella stand for use to support a patio umbrella 35 associated with a patio table 38 in conjunction with a patio deck 30 formed with flooring planks 31 can best be seen. As best seen in FIGS. 1–3, the patio umbrella stand 10 is formed from an upright tubular member 12 having an open top sized to receive the base of a patio umbrella mast 36. The upright tubular member 12 is preferably formed of steel pipe having a diameter of approximately one and three-quarters inches and is welded to a horizontally disposed, rectangular flange member 15 to project the upright tubular member 12 perpendicularly thereto. Below the rectangular flange 15, a vertical anchoring fin 20 is welded to the bottom of the rectangular flange 15 in a manner to position the axis 22 thereof perpendicular to the major axis 17 of the rectangular flange 15. The anchoring fin 20 is preferably formed with downwardly depending, opposing lobes 23, 24 with a notch 25 formed therebetween.

Preferably, though not a limitation of the size of the patio umbrella stand, the rectangular flange 15 is formed from a piece of sheet metal having a thickness of approximately one-eighth inch with perpendicular horizontal dimensions of about four inches by eleven inches. The upright tubular member 12 is preferably welded to the center of the rectangular flange 15. The vertical anchoring fin 20 is also preferably formed from one-eighth inch thick sheet metal to permit the passage thereof through the crack or gap 32 between the flooring planks of a conventional patio deck. The overall outside dimensions of the anchoring fin would be a vertical height of about four inches and about eight inches in horizontal length. The notch 25 between the opposing lobes 23, 24 would preferably have a height of about three and a quarter inches and a horizontal width of about two inches, leaving a three-quarter inch strip at the top of the anchoring fin 20 for welding to the underside of the rectangular flange 15. The two inch wide notch 25 leaves each of the generally symmetrical opposing lobes 23, 24 as having a horizontal width of about three inches.

Figure 5:
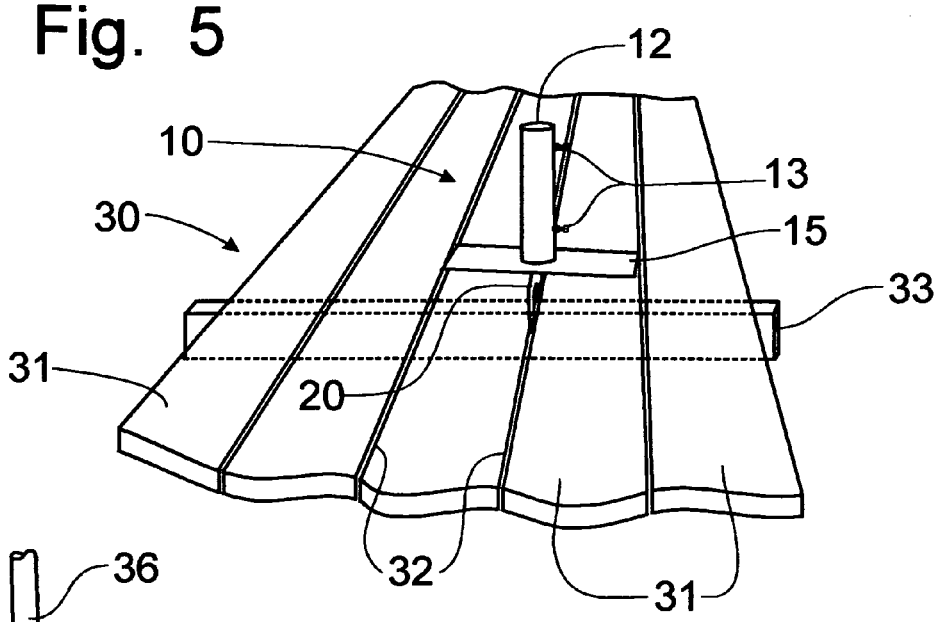
FIG. 5 is a schematic view of the patio umbrella stand similar to that shown in FIG. 4 with the anchoring fin being inserted into the gap between adjacent deck planks over top of a framing support beam.
Figure 6A:
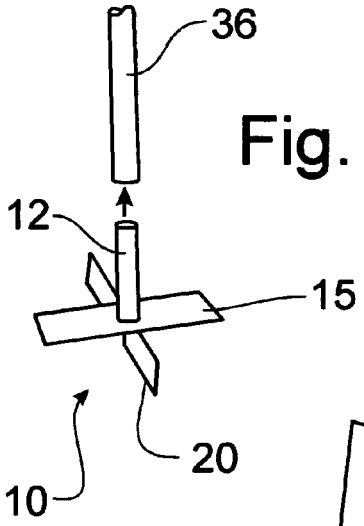
FIG. 6A is a schematic perspective view of an alternative embodiment of the umbrella stand in which the upright member is sized to be inserted into the end of a hollw umbrella mast.
Figure 6:
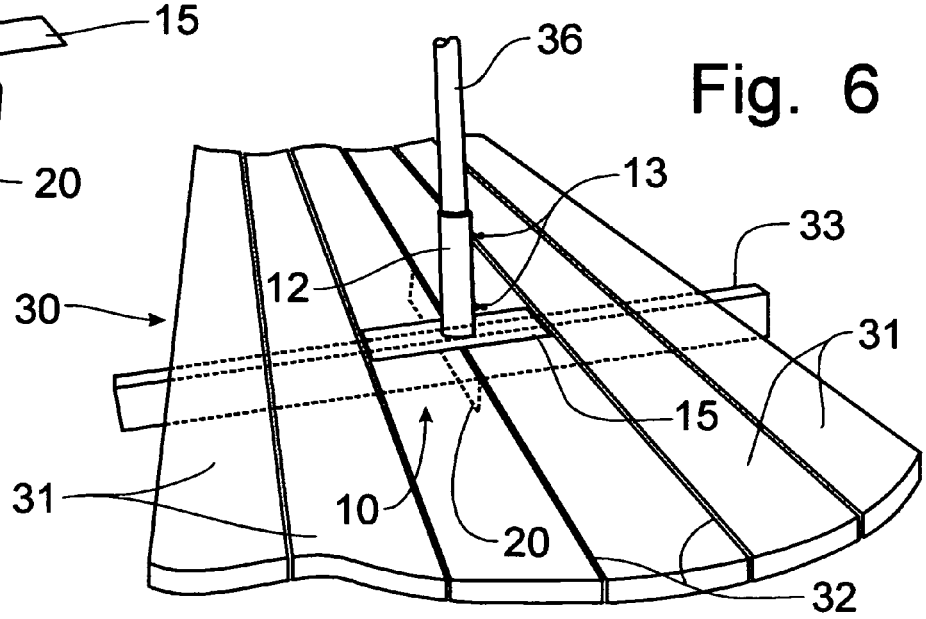
FIG. 6 is a schematic perspective view depicting the patio umbrella stand as shown in FIGS. 4 and 5 after placement into the patio deck flooring with the anchoring fins being received between the flooring members with a framing support beam positioned in the anchoring fin notch.

As depicted in FIGS. 5 and 6, the notch 25 is sized to fit over a cross beam 33 extending generally perpendicularly with respect to the patio deck 30. Typically, patio deck 30 is formed with decking planks 31 placed on framing supports 33 with a gap 32 of about one-eighth to three-sixteenth inch between adjacent flooring planks 31, which is adequate to receive the thickness of the vertical anchoring fin 20 between flooring planks 31. The notch 25 is provided to permit clearance of an conventional framing member, such as a cross beam 33 which is typically formed from a wooden plank having a nominal width of about one and a half inches, that would otherwise prevent the insertion of the anchoring fin 20 between the flooring planks 31. If the patio umbrella stand 10 is going to be placed at a location where no cross beam 33 exists, the anchoring fin 20 will not be impeded in its insertion into the patio deck 30. The rectangular flange 15 provides positional stability for the stand 10 on the top surface of the deck 30, while the anchoring fin 20 prevents movement of the stand 10 along the surface of the patio deck 30, particularly if the anchoring fin 20 is straddled over a cross beam (not shown) received within the notch 25.

Referring again to FIGS. 1–3, the upright tubular member 12 is preferably formed with a vertical height of about nine inches, which has been found to provide satisfactory stability for the base of the patio umbrella mast 36. The upright tubular member 12 is provided with a pair of vertically spaced set screws 13 that are threaded into the tubular member 12 to pass into the tubular member 12 and engage the base of the patio umbrella mast 36 to stabilize the mast 36 against the internal circumference of the tubular member 12. The set screws 13 can be formed with a nut 14 that is tack-welded to the exterior circumference of the tubular member 12 in alignment with a hole passing therethrough. The set screw 13 can then be threadably received in the nut 14 and extend into the tubular member 12 to engage the exterior of the patio umbrella mast 36.

Figure 7:
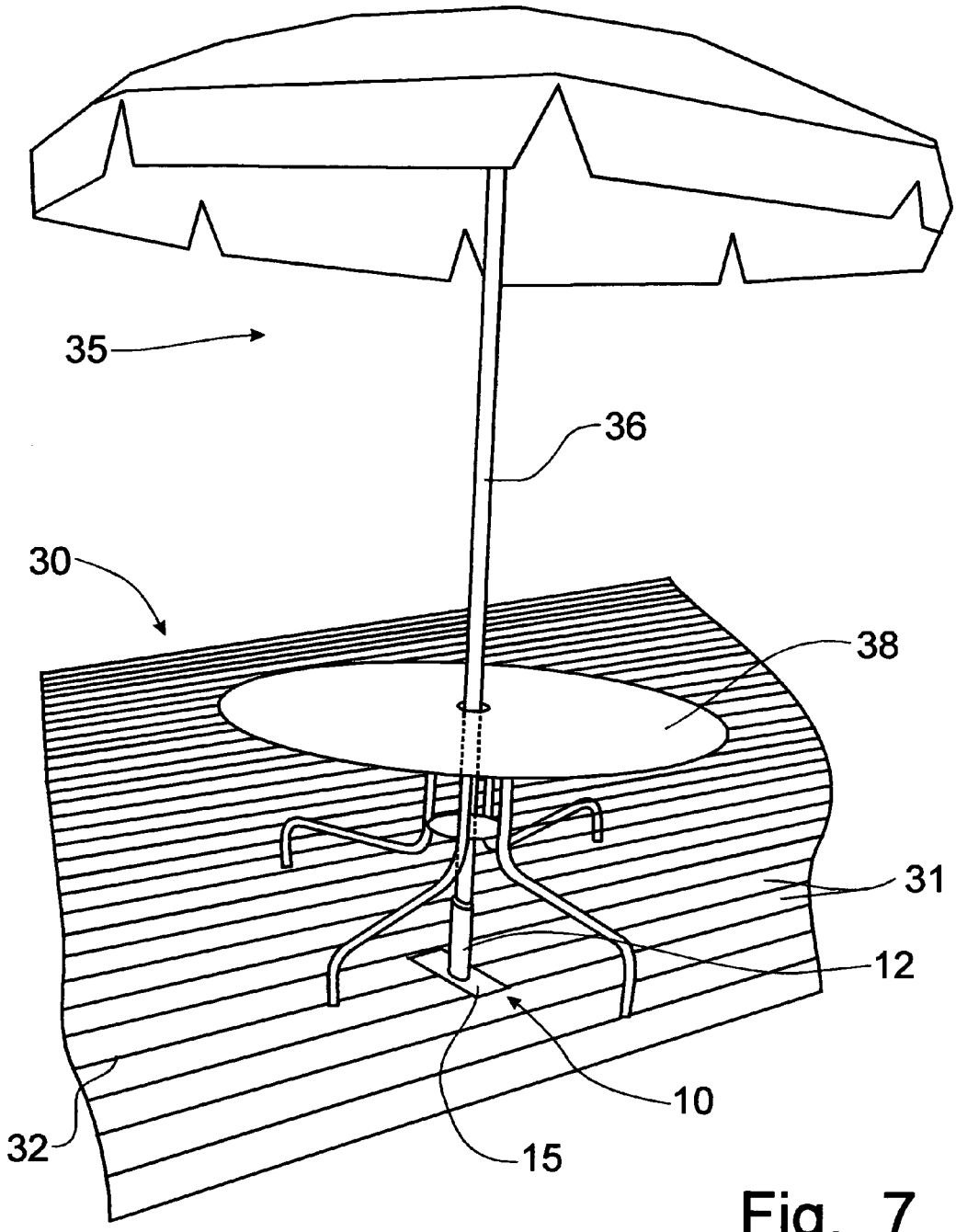
FIG. 7 is a schematic view depicting the patio umbrella stand in use supporting a patio umbrella passing through a conventional patio table with an opening therethrough for passage of the umbrella mast.

As best seen in FIGS. 6 and 7, such a configuration of the upright member 12 will preferably be sized to receive conventional umbrella masts 36 within the interior of the tubular member 12. Conventional umbrella masts are formed in substantially two forms, a solid mast which is typically made of wood, and a tubular or hollow mast which is typically formed of a lightweight metal such as aluminum. Usually, the hollow umbrella mast has a larger diameter than the solid variety. The upright member 12 is preferably sized to received the largest of the conventional hollow umbrella masts so that the smaller diameter masts can still be received within the tubular upright member 12. The set screws 13 provide an adjustment feature by which the umbrella mast 36 becomes detachably fixed against the upright member 12 when the set screws 13 push the mast 36 against the interior circumference of the upright member 12.

Alternatively, the upright member can be formed in multiple configurations, one of which will me more closely sized to fit the solid form of the umbrella mast 36 into the upright member 12. Another alternative configuration is depicted in FIG. 6A and would incorporate a solid upright member 12, as opposed to the tubular form depicted in the drawings, which would be sized to fit internally within the hollow umbrella masts 36. In such a configuration, the umbrella mast 36 would slide along the upright mast until stopped against the flanges 15 and provide a clean, uniform appearance. The set screws 13 would not be utilized as the hollow umbrella mast 36 would not be able to slide over the exterior of the upright member 12.

Referring now to FIGS. 4–7, the patio umbrella stand 10 is used by positioning the stand 10 at the approximate location on the deck 30, such as underneath a patio table 38 where a patio umbrella 35 passes through the table 38. The anchoring fins 20 are then aligned with a gap 32 between two adjacent flooring planks 31 and inserted between the planks 31 until the rectangular flange member 15 rests on top of the flooring 31. In the event a cross frame member 33 is within the area covered by the anchoring fins 20, the stand 10 must be positioned such that the notch 25 is fit over the cross beam 33 with one of the fin lobes 23, 24 being positioned on either side of the cross beam. If no cross beam 33 is encountered, the stand 10 can be moved along the gap 32 between the adjacent floor planks 31 until appropriately aligned with the desired location for the patio umbrella 35. The base of the umbrella mast 36 is then placed into the upright tubular member 12 to be received therein, or in the embodiment of FIG. 6A placed over the upright member 12. The rectangular flange member 15 and the anchoring fins 20 restrain the stand 10 from tipping, particularly if the anchoring fin 20 is straddling a cross beam frame member 33 which is received within the notch 25.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. An apparatus for supporting an umbrella on a deck formed with deck planks having a thickness dimension and defining a top surface of said deck, said deck planks being positioned with a gap between adjacent planks, said umbrella including a mast, comprising:

a base member including a pair of opposing flanges oriented for engagement with said top surface of said deck;

an upright member projecting upwardly and centrally from said base member for engagement with said umbrella mast; and an anchoring fin affixed to said base member at a central position relative to said base member and extending downwardly therefrom generally perpendicularly to said base member, said anchoring fin being positionable through said gap between adjacent deck planks, said anchoring fin having a depth dimension measured from said base member, said anchoring fin being formed with a notch sized to fit over a transversely extending frame member of said deck positioned below said deck planks.

2. The apparatus of claim 1 wherein said notch is centrally located on said anchoring fin and has a depth that is smaller than said depth dimension of said anchoring fin.

3. The apparatus of claim 2 wherein the difference in the depth of said notch and said depth dimension of said anchoring fin is substantially equal to said thickness dimension of said deck planks.

4. The apparatus of claim 1 wherein said upright member is tubular to receive said umbrella mast internally of said upright member.

5. The apparatus of claim 4 wherein said upright member includes at least one adjustment member cooperable with said upright member to engage said umbrella mast and detachably secure said umbrella mast against an interior surface of said tubular upright member.

6. The apparatus of claim 5 wherein said adjustment member is a set screw threadably engaged in a sidewall of said upright member to extend internally of said upright member and engage said umbrella mast.

7. The apparatus of claim 1 wherein said upright member is sized to fit internally of a hollow said umbrella mast.

8. The apparatus of claim 1 wherein said flanges are formed with substantial width and length dimensions to stabilize said upright member on said top surface of said deck, said anchoring fin providing positional stability for said upright member with respect to movement over said top surface.

9. In a stand for removably mounting a mast member of furniture on a deck formed from deck planks having a thickness dimension and defining a top surface of said deck, said deck planks being spaced apart by a gap, said stand having an upright member engagable with said mast member for support thereof and a base member positionable against said top surface of said deck for positional stability of said upright member, the improvement comprising:

an anchoring fin centrally affixed to said base member and being positionable through said gap between said deck planks to provide positional stability of said stand with respect to movement over said top surface of said deck said anchoring fin having a depth dimension greater than said thickness dimension of said deck planks so that said anchoring fin extends below said deck planks; wherein said base member is formed with a pair of opposing flanges with said upright member being substantially centrally positioned between said flanges; and wherein said anchoring fin is formed with a notch sized to fit over a frame member of said deck positioned below said deck planks.

10. The stand of claim 9 wherein said anchoring fin has a major axis that is oriented in a first direction, said opposing flanges defining a second major axis that is oriented perpendicularly to said major axis of said anchoring fin.

11. The stand of claim 9 wherein said upright member is tubular to receive said umbrella mast internally of said upright member, said upright member including at least one adjustment member cooperable with said upright member to engage said umbrella mast and detachably secure said umbrella mast against an interior surface of said tubular upright member.

12. The stand of claim 11 wherein said adjustment member is a set screw threadably engaged in a sidewall of said upright member to extend internally of said upright member and engage said umbrella mast.

13. A patio umbrella support stand for supporting a patio umbrella on a deck formed with deck planks having a thickness dimension and defining a top surface of said deck, said deck planks being positioned with a gap between adjacent planks, said patio umbrella including a mast, comprising:

a base member including a pair of opposing flanges oriented for engagement with said top surface of said deck;

an upright member projecting upwardly from said base member for receipt of said umbrella mast, said upright member being substantially centrally positioned between said flanges; and an anchoring fin centrally affixed to said base member and extending downwardly therefrom generally perpendicularly to said base member, said anchoring fin being positionable through said gap between adjacent deck planks to provide positional stability of said stand with respect to movement over said top surface of said deck, said anchoring fin having a depth dimension measured from said base member and being greater than said thickness dimension of said deck planks so that said anchoring fin extends blow said deck planks, said anchoring fin being formed with a notch sized to fit over a transversely extending frame member of said deck positioned below said deck planks.

14. The patio umbrella support stand of claim 13 wherein said notch is centrally positioned on said anchoring fin and has a depth dimension that is smaller than said depth dimension of said anchoring fin.

15. The patio umbrella support stand of claim 14 wherein the difference in the depth of said notch and said depth dimension of said anchoring fin is substantially equal to said thickness dimension of said deck planks.

16. The patio umbrella support stand of claim 15 wherein said upright member is tubular and includes at least one set screw threadably engaged in a sidewall of said upright member to engage said umbrella mast and detachably secure said umbrella mast against an interior surface of said tubular upright member.

* * * * *